US006045717A

United States Patent [19]

Wolf et al.

[11] Patent Number: 6,045,717

[45] Date of Patent: Apr. 4, 2000

[54] FILLING THE ANNULUS BETWEEN CONCENTRIC TUBES WITH RESIN

[75] Inventors: Jerry M. Wolf, Powell; Hiten T. Shah, Delaware; Steven J. Crosbie, Prospect; James D. Crosbie, Delaware, all of Ohio

[73] Assignee: Acoust-A-Fiber Research and Development, Inc., Delaware, Ohio

[21] Appl. No.: 09/021,144

[22] Filed: Feb. 10, 1998

Related U.S. Application Data

[60] Continuation-in-part of application No. 08/912,818, Aug. 19, 1997, Pat. No. 5,908,059, which is a division of application No. 08/653,494, May 24, 1996, Pat. No. 5,706,869.

[51] Int. Cl.[7] ..... E04B 1/74; C04B 14/38; C04B 28/00

[52] U.S. Cl. ..... 252/62; 501/95.1

[58] Field of Search ..... 252/62; 501/95.1; 524/841, 876; 523/145

[56] References Cited

U.S. PATENT DOCUMENTS

| | | | |
|---|---|---|---|
| 3,439,075 | 4/1969 | Bauer et al. | 264/46.1 |
| 3,950,461 | 4/1976 | Levens | 264/46.6 |
| 4,104,481 | 8/1978 | Wilkenloh et al. | 174/28 |
| 4,248,752 | 2/1981 | Myles | 501/95.1 |
| 4,626,466 | 12/1986 | Schmidt et al. | 106/38.27 |
| 4,963,420 | 10/1990 | Jarrin et al. | 428/36.9 |
| 5,053,362 | 10/1991 | Chi et al. | 501/95.1 |

*Primary Examiner*—C. Melissa Koslow
*Attorney, Agent, or Firm*—Christen M. Millard; Kremblas, Foster, Millard & Pollick

[57] ABSTRACT

Concentric conduits are supplied for the purpose of minimizing heat transfer from within the inner conduit through the outer conduit. The air gap or annulus around the inner conduit is filled with a resin mixture which is mixed with vermiculite and mineral fiber to form a slurry. The slurry is pumped into an open end of the annulus to fill the annulus and enhance the heat insulation characteristics of the concentric conduits.

8 Claims, 4 Drawing Sheets

FILLING THE ANNULUS BETWEEN CONCENTRIC TUBES WITH RESIN

CROSS REFERENCES TO RELATED APPLICATIONS

This application is a continuation-in-part of application Ser. No. 08/912,818 filed Aug. 19, 1997 now U.S. Pat. No. 5,908,059 which is a divisional of application Ser. No. 08/653,494 filed May 24, 1996, now U.S. Pat. No. 5,706,869.

BACKGROUND OF THE INVENTION

1. Field of the Invention

This invention relates to the filling of the annulus between concentric tubes with a heat insulation slurry which hardens in place.

2. Description of the Related Art

In the automotive industry the transfer of hot exhaust gases from the exhaust manifold in an engine compartment to a tail pipe is a problem because many of the operating components in the engine compartment in proximity to the exhaust system may be prematurely damaged or aged by excessive heat. High temperature operating systems which are not necessarily limited to the automotive industry face the same problem.

As a result of the existing problem, an industry has risen which provides concentric metal tubes or conduits of some length having a flange secured at one end to hold them in proper orientation. That is, the radially spaced tubes provide a heat insulating air gap between the two conduits. Unfortunately, the air gap is not adequate to maintain the outer tube at a suitable low temperature.

What is needed is a mechanism for filling the annulus between the concentric conduits with a material having a low coefficient of thermal conductivity to increase the insulation factor between the inner and outer conduits.

Techniques for forming concentric tubes from some material (usually steel) with an annular gap between the two conduits is a known technology. A patent to Wilkenloh, U.S. Pat. No. 4,104,481 teaches a technique for forming concentric tubes with a foamable resin in the gap between the tubes. The purpose of the resin filling the annulus between the two conduits is to create a dielectric shield between concentric conductors of electricity. The technique used to form the layers of strands of electrically conducting cable is to form the layers sequentially from the inside out.

A patent to Jarrin et al., U.S. Pat. No. 4,963,420 is a similar technique where there are a plurality of inner conduits or cables surrounded by an outer sheath. Again the technique for forming the composite cable is to form the inner conduits and feed them through a nozzle system where the insulation material is extruded in surrounding relationship and thereafter passing the composite conduit through another extrusion process where the outer conduit is formed.

The system described in relation to these two patents is certainly a suitable solution to some problems in some industries, but the particular problem in the existing system does not lend itself to this particular technique. The metallic conduits of the existing system are formed as a unit and have an integral flange at one end. The end of the concentric conduits remote from the flange is open. That is, the inner tube has a completely open passage suitable for the transmission of hot gasses or liquids. The gap or annulus between the concentric conduits is open at that one remote end only. The concentric conduits are structured to be welded or otherwise mechanically attached to some other system where the inner conduit will convey the hot gas or liquid from one end to the other. The air gap between the conduits is to serve as an insulation barrier to minimize the heat transfer from the hot fluid being conveyed to the outer conduit. In those environments where the temperature of the outer conduit rises to an undesirable level over time a solution must be found to shield other operating components in the vicinity of the outer conduit from heat radiation and/or conduction. Certainly one technique is to apply an insulation to the exterior of the outer conduit. The reason such a technique is not desirable is because the externally applied insulation layer may be scraped or displaced during assembly of the concentric conduits.

SUMMARY OF THE INVENTION

A preferred technique is to fill the gap or annulus between the concentric conduits with a heat insulation material after the conduits are formed with the integral flange attached at one end and before the concentric conduits are shipped to the assembly site where they will be mounted to conduct hot fluids.

This invention resulted from experiments to find a suitable slurry which may be pumped through the open end of the annulus toward the flanged end of the concentric conduits to fill the gap between the two conduits and provide the desired degree of insulation. The slurry can include a variety of high temperature materials such as fiberglass, mineral fiber, slag wool, rock wool, ceramic fiber, vermiculite or any mixture thereof. This base material is immersed and mixed thoroughly into a binder system, not limited to phenol formaldehyde, silica, ceramic putty or water. In the environment in which this set of conduits is structured to work, the radial width of the annulus may be as small as one quarter inch, but more commonly will be in the nature of one-half inch.

The resin slurry is initially mixed to a uniform consistency and pumped from some source such as a barrel or bucket through a nozzle into the annular area surrounding the inner conduit. A nozzle fits over the open ends of the conduits. The nozzle comprises a unique structure being formed of a tube having an inlet on one end and incorporating a pair of sleeves which form an outlet at the other end. The inner sleeve of the nozzle includes a transverse wall which blocks the exit of any fluids inwardly of the inner sleeve. An aperture in the nozzle upstream of the transverse wall allows the pumped resin slurry to pass between the sleeves and into the annulus between the concentric conduits.

One or more holes is provided in the outer conduit near to the integral flange to allow the escape of air from the annulus as the slurry flows from the nozzle into the annulus and progresses toward the flange. The hole serves another purpose, it also allows the operator of the system to see when the annulus has been filled with the resin slurry because the slurry will start to dribble out of the hole.

Objects of the invention not understood from the above will be abundantly clear upon a review of the drawings described subsequently and a review of the description of the preferred embodiment which follows.

Figure 1:
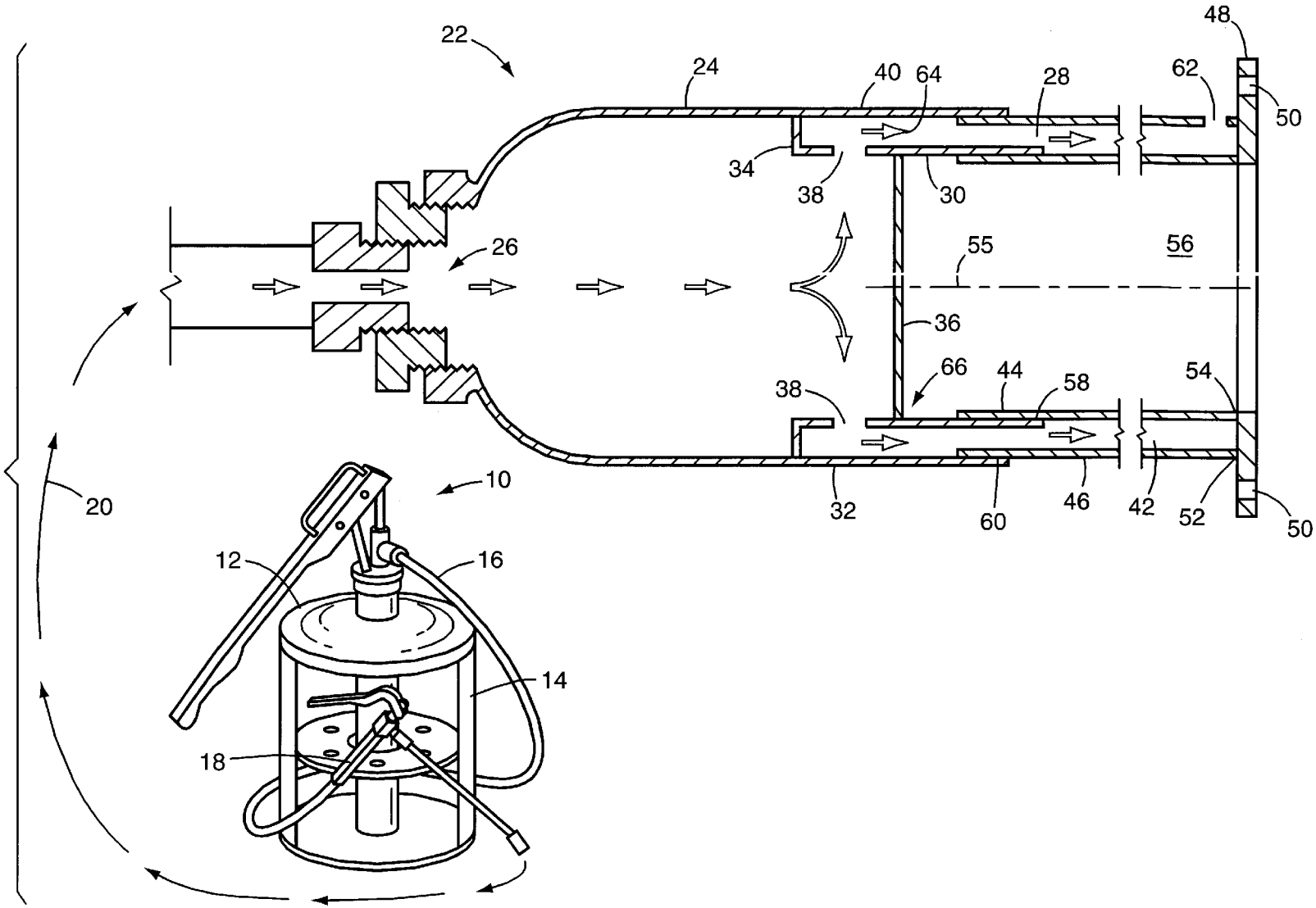
FIG. 1 is a schematic view of the apparatus for injecting resin slurry into the annular gap between concentric tubes including the nozzle shown in section.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other circuit elements where such connection is recognized as being equivalent by those skilled in the art.

BRIEF DESCRIPTION OF THE PREFERRED EMBODIMENT

Looking to FIG. 1, a conventional pump 10 is mounted on a lid 12 supported by a framework 14. The lid and framework are designed to fit inside a bucket or barrel (not shown) to pump the liquid from the barrel. Such pump and container structure is conventional and need not be described in detail.

The liquid pumped from the barrel exits through a hose 16 and is discharged from the hose though a valve structure 18 which is also conventional. Fluid passing through valve 18 ultimately moves through duct work in the form of a hose or the like 20 to a nozzle indicated generally at 22.

Nozzle 22 is connected to conduit 20 such that fluid delivered from the barrel enters a tube 24 through a feed opening 26.

At the opposite end of nozzle 22 is a discharge opening 28. Discharge opening 28 is formed by a pair of concentric inner and outer sleeves 30, 32, respectively.

In the particular embodiment illustrated, outer sleeve 32 is coextensive with the side wall of tube 24. Inner sleeve 30 is supported concentrically within sleeve 32 by an inwardly projecting annular flange 34. It will be appreciated that inner sleeve 30 could be a coextensive extension of tube side wall 24 and the outer sleeve 32 could be supported by a radially outwardly extending flange 34. Such structure would be equally operable.

An impermeable barrier wall 36 extends transversely completely across the opening between the inner surfaces of inner sleeve 30 such that no fluid passes from nozzle 22 inside sleeve 30.

A plurality of apertures 38 allow the radial passage of fluid entering the nozzle at feed opening 26 to flow radially outwardly through inner sleeve 30 into the annular passage 40 between sleeves 30 and 32 and ultimately to be discharged through discharge opening 28.

Figure 2:
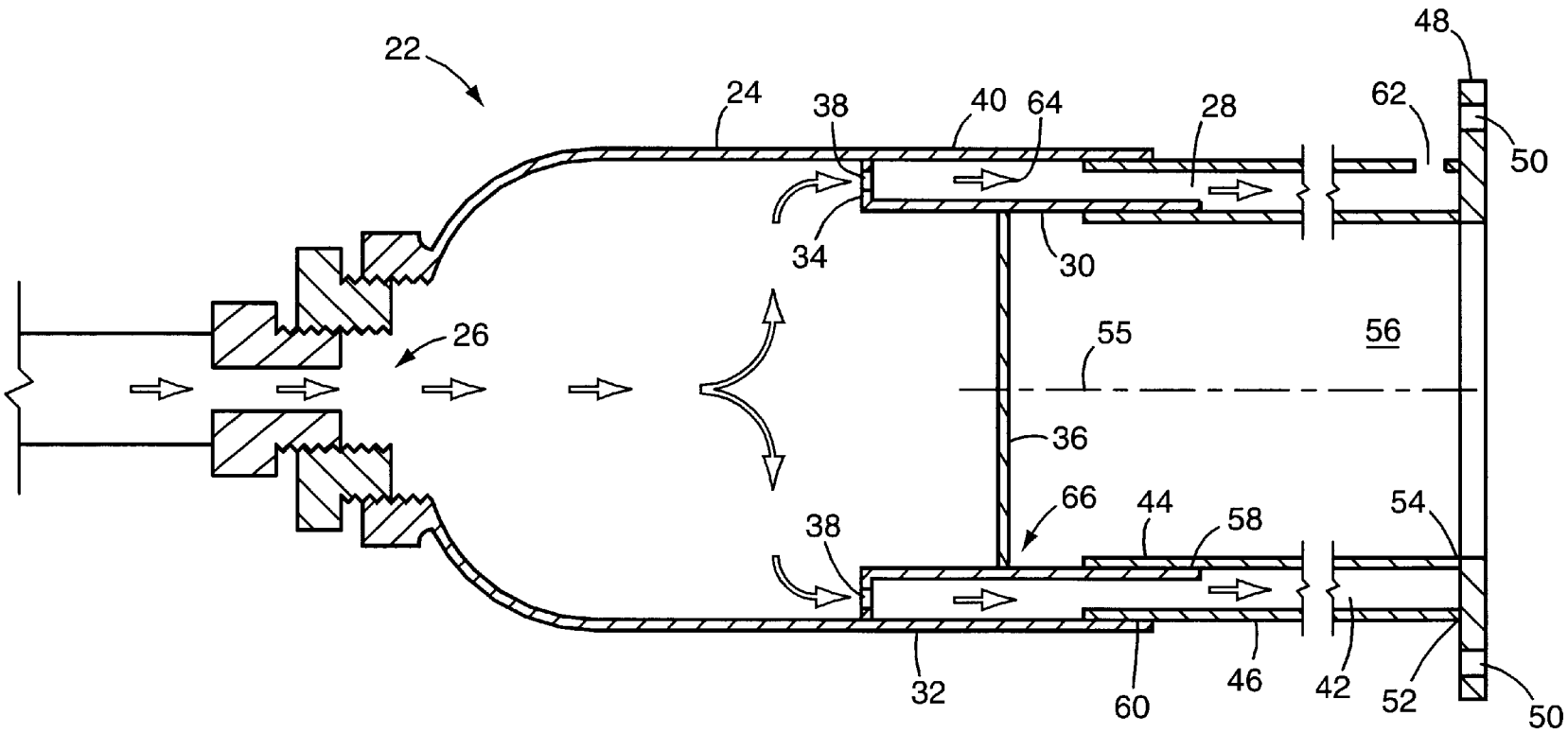
FIG. 2 is a schematic view of another embodiment for injecting resin slurry into the annular gap between concentric tubes including the nozzle shown in section.

Modifications may be made to the precise location of the apertures 38. As shown in FIG. 2, the apertures 38 may be located in the flanges 34, rather than in the inner sleeve 30. Also, the apertures 38 may be located at any point along the inner sleeve 30. The embodiment of the nozzle 22 as shown in FIG. 2 is identical in form and usage to the embodiment of the nozzle 22 shown in FIG. 1 apart from the precise location of the apertures 38.

An additional configuration is also possible, but is less preferred and not separately illustrated in the drawings. The inner sleeve 30 may be secured to the impermeable wall 36, but not to the outer sleeve 32. In such a case, there would be no need for a flange 34 and the aperture 38 would be the opening between the inner sleeve 30 and the outer sleeve 32. This configuration is less preferred due, at least in part, to the preferred composition of the slurry, which is discussed later. Once the nozzle 22 is assembled on the concentric conduits 44, 46, the slurry is injected. If the inner sleeve 30 and the outer sleeve 32 are not attached in some way, an operator would need to manually remove the inner sleeve 30 and impenetrable wall 36 or some other apparatus must be used to accomplish removal thereof. Since the slurry may be toxic or corrosive, it is not desirable to remove the inner sleeve 30 and impenetrable wall 36 manually. In addition, some slurry would likely be wasted by draining out of the tube 24. Thus, while it is intended that such a configuration be understood to be within the scope of the claims, the configuration is the most desirable.

Nozzle 22 is particularly structured to deliver a resin slurry into an annulus 42 formed between concentric inner and outer conduits 44, 46, respectively. Such concentric conduit structure is supplied from a manufacturer already assembled in concentric configuration. The conduits are held in place by an integral flange 48. In the structure shown flange 48 serves as a bridge, blocking the passage of fluid through said annulus where said conduits 44, 46 are secured together.

Flange 48 is conventional and includes conventional bolt holes 50. In the illustrated embodiment, conduits 44 and 46 are shown as being welded to flange 48 at 52 and 54. This allows the radially extending flange 48 to hold the conduits 44 and 46 in their concentric, radially spaced position, concentric about an axis 55 extending the length of the hot liquid conducting element which is structured to transmit hot fluid in air duct 56 from one end to the other when it is assembled in operative condition.

The resin slurry to be pumped from the barrel by pump 10 through nozzle 22 and into the annular gap 40 between conduits 44 and 46 includes a combination of water, fibers and binders. The water is provided and fibers and binders are added such that the water is between about 50% and about 75% by weight of the slurry, the fibers are between about 25% and about 48% by weight, and the binders are between about 2% and about 5% by weight. The most preferred formulation uses water at about 60% by weight, fibers at between about 35% and about 38% by weight, and the binder at about 2% by weight. Other materials, such as fillers or thickeners, may also be included.

The fibers which are used in the present invention may be selected from the following: fiberglass, silica, ceramics, vermiculite, or a blend of some or all thereof. One of ordinary skill in the art is able to select from the above materials based on their insulating abilities and the requirements in a particular setting without undue experimentation. The binder may be a phenolic resin, including phenol formaldehyde, silica, ceramic putty or the like, depending on the precise fiber used. The preferred binder is a phenolic resin.

The resin slurry may also contain portions of methyl alcohol and the like, such that the resin slurry will set over time after it is pumped into the operative annular gap described previously. The fibers tend to settle in the slurry if it is allowed to stand prior to being injected into the annulus. Accordingly, agitating and mixing the components is desirable immediately prior to injecting them into their intended location.

Filling Procedure

The pumpable resin slurry is suitably mixed to a uniform or consistent mixture in a barrel and is pumped by pump 10 through hose 16 and duct 20 to an entrance or feed opening 26 in a nozzle 22.

Prior to beginning the pumping operation, the nozzle 22 is assembled on the free end of the concentric conduits 44, 46. Note that inner sleeve 30 projects beyond the termination point of sleeve 32. This facilitates the sliding of the nozzle into operative position in the free end of the concentric conduits. Further, it allows visual assurance that each sleeve 30, 32 engages one of the concentric conduits 44, 46. In order for the nozzle 22 to be assembled and slide on the free end of the concentric conduits 44, 46, the geometric configuration of the discharge opening 28 must correspond to the geometric configuration of the annulus 42 formed by the concentric conduits 44, 46, as is apparent from the FIGS. In present usage, the annulus 42 is round and thus the nozzle 22 must be round.

The pumpable resin is somewhat viscous in its consistency, but it is preferred that some sealing mechanism be incorporated with the concentric sleeves 30, 32. In the illustrated embodiment, annular o-rings 58, 60 are mounted on the internal surfaces of sleeves 30 and 32 to serve this sealing feature. It will be understood very clearly that other means for sealing may be adopted if desired. Indeed, no sealing mechanisms may be required in all situations because of the viscosity of the phenyl formaldehyde resin.

Figure 3:
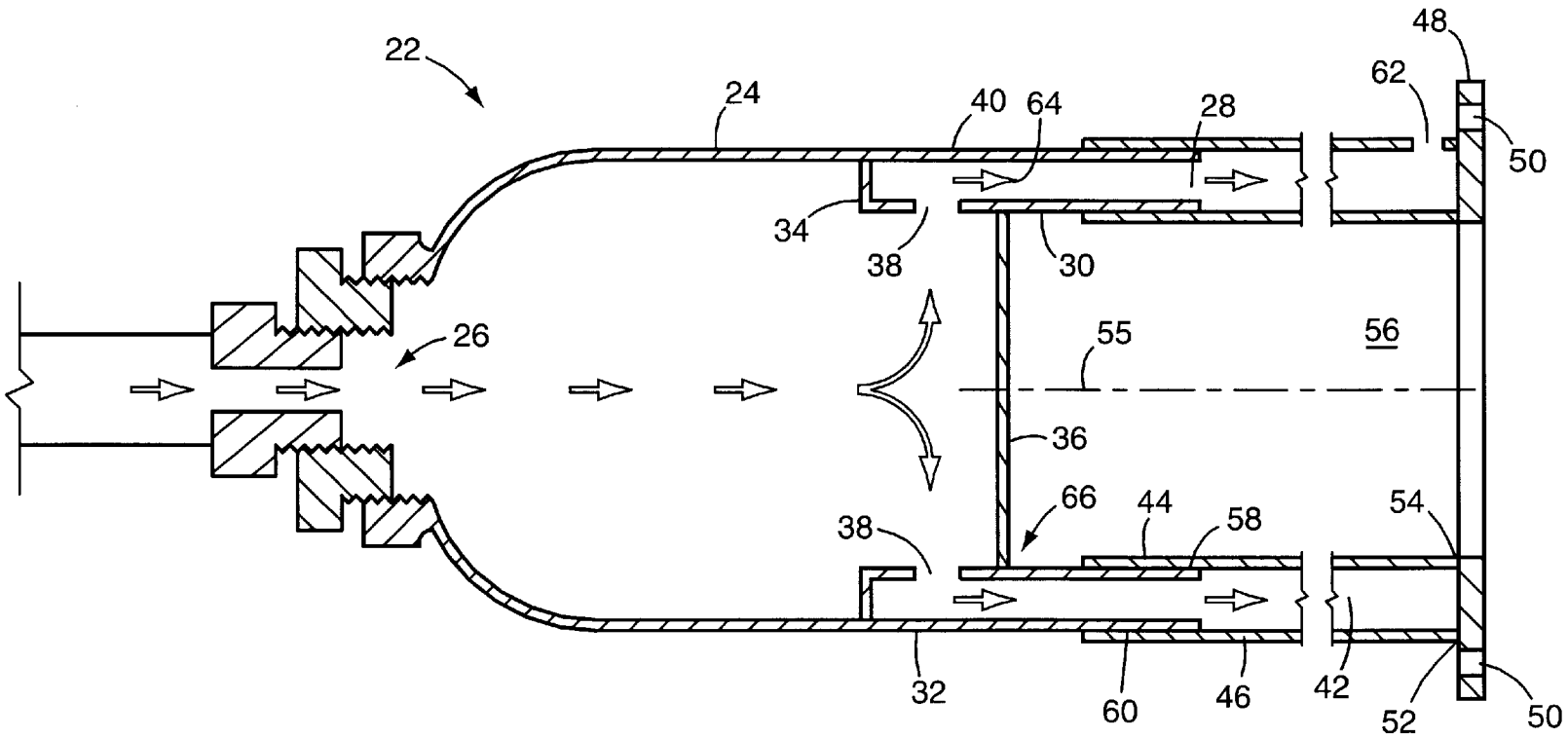
FIG. 3 is a schematic view of yet another embodiment for injecting resin slurry into the annular gap between concentric tubes including the nozzle shown in section.
Figure 4:
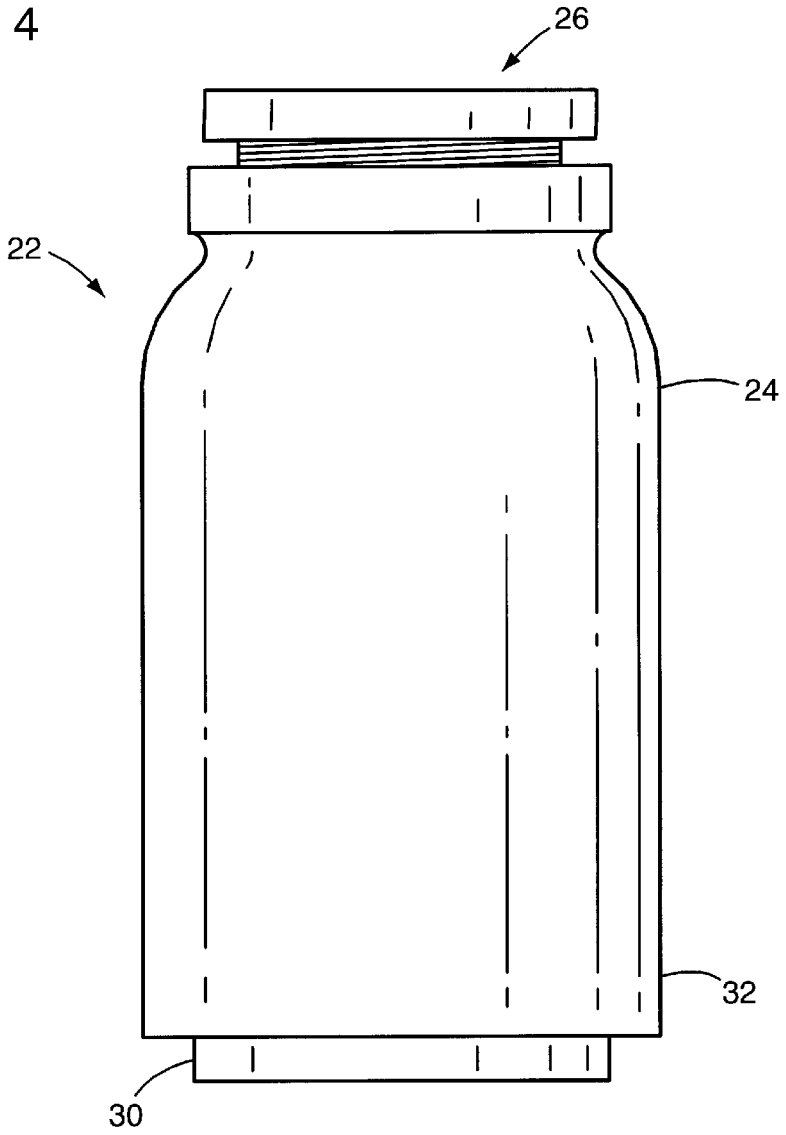
FIG. 4 is a side elevational view of the nozzle of FIG. 1.
Figure 5:
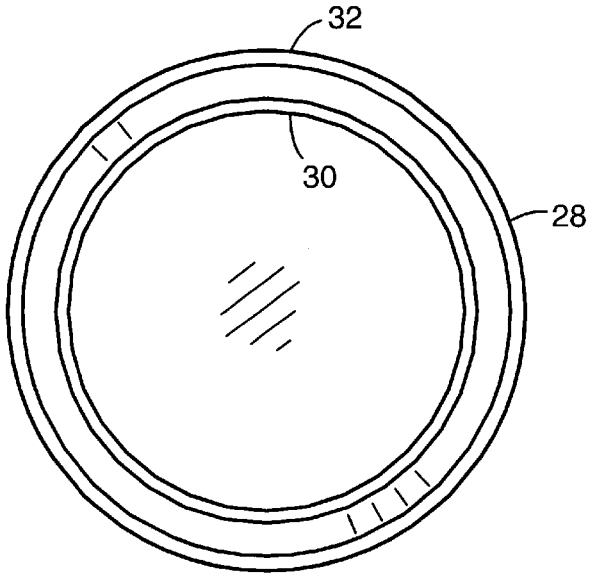
FIG. 5 is an end elevational view of the nozzle of FIG. 2.

Modification may be made to the precise configuration of the concentric sleeves 30, 32 and the annular o-rings 58, 60. As shown in FIG. 3, the termination point of the inner sleeve 30 may be the same as the termination point of the outer sleeve 32. In addition, the nozzle 22 may be configured such that both concentric sleeves 30, 32 fit within the annulus 42 formed by the concentric conduits 44, 46. In such a case, the placement of one of the annular o-rings 60 must change such that the o-ring 60 is mounted on the external surface of the outer sleeve 32. The embodiment of the nozzle 22 shown in FIG. 3 is otherwise identical to the embodiment of the nozzle 22 as shown in FIG. 1.

As the resin is pumped into the nozzle 22 it progresses toward impermeable wall 36 and then flows radially through apertures 38 into the annular passage 40 and then longitudinally into the annulus 42 formed by the concentric conduits 44, 46. The resin flows longitudinally along the conduits until it abuts the surface of the flange 48. All the while, the air in the annulus 42 escapes through the bleed hole 62 in the outer conduit 46.

As soon as the annulus 42 is filled with the resin, it will begin to drip or extrude out of the hole 62 which is a test or gauge for the operator to know that the annulus is full and the pumping can stop.

To facilitate the intended use of the annular conduits incorporating the solidified resin, a gap of about one-half inch at the open end 64 of annulus 42 is to be maintained. This is accomplished by providing an abutment 66 to limit the insertion of the nozzle into open end 64 to about one-half inch. In the preferred embodiment the abutment 66 is the radially outer portion of wall 36 where it is sealingly secured to the inner surface of inner sleeve 30. Obviously, other abutment or flange type structures could be designed without departing from the spirit of the invention.

Having described the invention in its preferred embodiment obvious structural and procedural modifications could be made by those having ordinary skill in the art without departing from the spirit of the invention. Accordingly, it is not intended that the invention be limited by the words used to describe the invention nor the drawings illustrating the same. Rather it is intended that the invention be limited only by the scope of the appended claims.

We claim:

1. A mixture forming liquid slurry for injecting into the annulus between generally concentric conduits to form a heat transfer barrier consisting essentially of, by weight:

between about 50% and about 67% water;

between about 31% and about 48% fibers; and between about 2% and about 5% inorganic binder.

2. The mixture forming a liquid slurry according to claim 1, wherein said slurry comprises, by weight:

about 60% water;

between about 35% and about 38% fibers; and about 2% inorganic binder.

3. The mixture forming a liquid slurry according to claim 1, wherein said fibers are selected from the following: fiberglass, silica, ceramic, vermiculite, and mixtures thereof.

4. The mixture forming a liquid slurry according to claim 2, wherein said fibers are selected from the following: fiberglass, silica, ceramic, vermiculite, and mixtures thereof.

5. The mixture forming a liquid slurry according to claim 1, wherein said binder is selected from the following: silica and ceramic putty.

6. The mixture forming a liquid slurry according to claim 2, wherein said binder is selected from the following: silica and ceramic putty.

7. The mixture forming a liquid slurry according to claim 3, wherein said binder is selected from the following: silica and ceramic putty.

8. The mixture forming a liquid slurry according to claim 4, wherein said binder is selected from the following: silica and ceramic putty.

* * * * *